US005965314A

United States Patent [19]

Herman et al.

[11] Patent Number: 5,965,314

[45] **Date of Patent: *Oct. 12, 1999**

[54] INTERMEDIATE TRANSFER ELEMENT FOR LIQUID ELECTROPHOTOGRAPHY

[75] Inventors: Gay L. Herman, Cottage Grove; Claire A. Jalbert, St. Paul; Kent E. Emerson, South St. Paul, all of Minn.; James A. Baker, Hudson, Wis.

[73] Assignee: Minnesota Mining and Manufacturing Company, St. Paul, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/833,169

[22] Filed: Apr. 3, 1997

[51] Int. Cl.[6] ..... G03G 13/16

[52] U.S. Cl. ..... 430/126; 399/308

[58] Field of Search ..... 430/126; 399/308

[56] References Cited

U.S. PATENT DOCUMENTS

| | | | |
|---|---|---|---|
| 3,811,765 | 5/1974 | Blake | 355/3 |
| 4,522,866 | 6/1985 | Nishikawa et al. | 428/216 |
| 5,047,808 | 9/1991 | Landa et al. | 355/277 |
| 5,099,286 | 3/1992 | Nishise et al. | 355/272 |
| 5,119,140 | 6/1992 | Berkes et al. | 355/273 |
| 5,337,129 | 8/1994 | Badesha | 355/275 |
| 5,340,679 | 8/1994 | Badesha et al. | 430/126 |
| 5,352,558 | 10/1994 | Simms et al. | 430/125 |
| 5,552,869 | 9/1996 | Schilli et al. | 355/256 |
| 5,571,463 | 11/1996 | Sypula et al. | 264/45.9 |
| 5,585,905 | 12/1996 | Mammino et al. | 355/272 |
| 5,650,253 | 7/1997 | Baker et al. | 430/119 |
| 5,723,251 | 3/1998 | Moser | 430/126 |
| 5,761,595 | 6/1998 | Tarnawskyj et al. | 430/126 |

FOREIGN PATENT DOCUMENTS

| | | |
|---|---|---|
| 0 444 870 | 4/1991 | European Pat. Off. . |
| WO 96/34318 | 10/1996 | WIPO . |
| WO 97/12286 | 3/1997 | WIPO . |

*Primary Examiner*—John Goodrow
*Attorney, Agent, or Firm*—William D. Bauer

[57] ABSTRACT

The invention is an intermediate transfer element for liquid electrophotography comprising a material which is capable of absorbing the carrier liquid in amounts from 5 to 100% by weight based on the weight of the absorbing material, as well as, a system incorporating that element and a method of creating an image using that element.

27 Claims, 1 Drawing Sheet

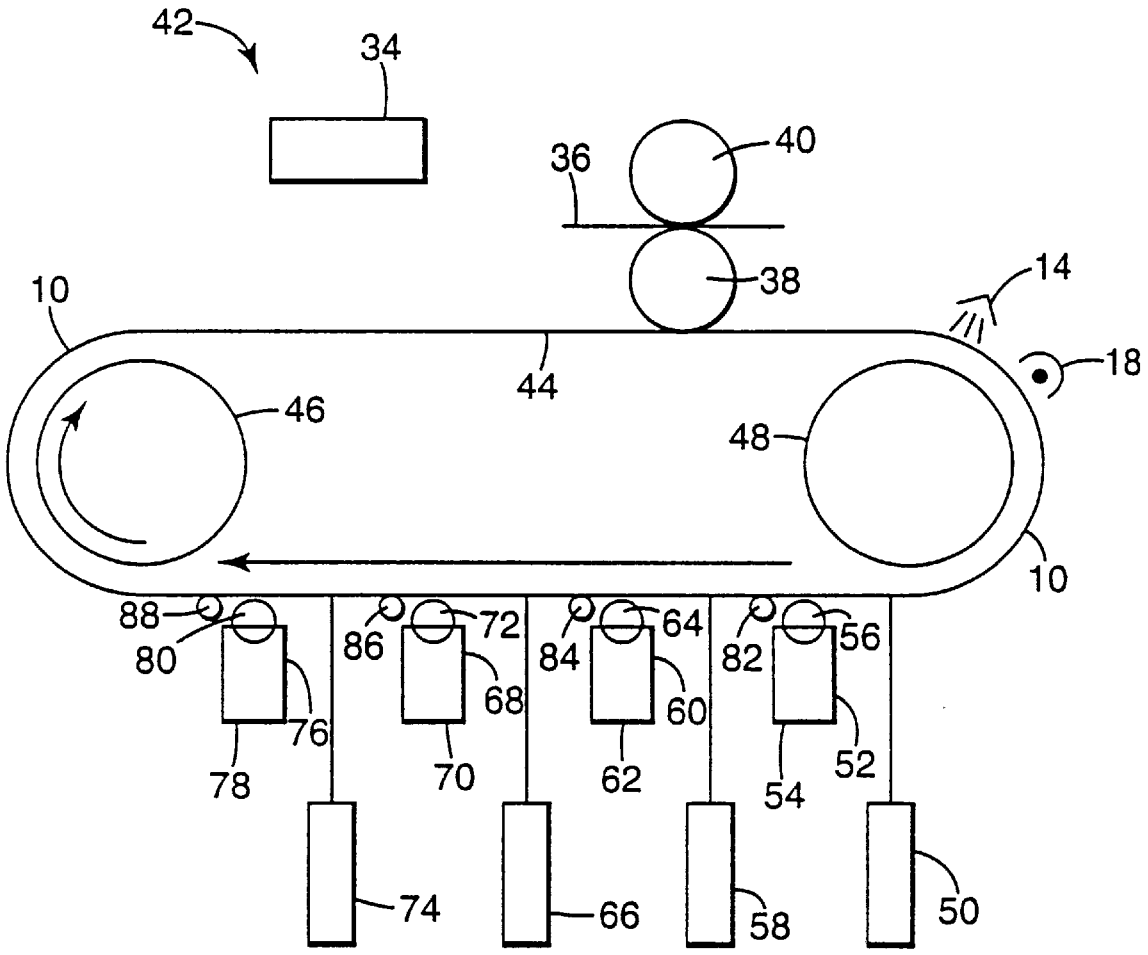
Fig.

INTERMEDIATE TRANSFER ELEMENT FOR LIQUID ELECTROPHOTOGRAPHY

FIELD OF THE INVENTION

This invention relates to an intermediate transfer element for liquid electrophotography. This invention further relates to a liquid electrophotographic system which does not require a drying step between formation of the image on the photoconductor and transfer of that image to the intermediate transfer element.

BACKGROUND OF THE INVENTION

Electrophotography forms the technical basis for various well known imaging processes, including photocopying and some forms of laser printing. The basic electrophotographic process involves placing a uniform electrostatic charge on a photoreceptor (also referred to as a photoconductor element), imagewise exposing the photoreceptor to activating electromagnetic radiation, also referred to herein as "light", thereby dissipating the charge in the exposed areas, developing the resulting electrostatic latent image with a toner, and transferring the toner image from the photoreceptor to a final substrate or receptor, such as paper, either by direct transfer or via an intermediate transfer material.

Typically, a positively charged toner is attracted to those areas of the photoconductor element which retain a negative charge after the imagewise exposure, thereby forming a toner image which corresponds to the electrostatic latent image. The toner need not be positively charged. Some toners are attracted to the areas of the photoconductor element where the charge has been dissipated. The toner may be either a powdered material comprising a blend of polymer and colored particulates, typically carbon, or a liquid material of finely divided solids dispersed in an insulating liquid frequently referred to as a carrier liquid. Liquid toners are often preferable because they are capable of giving higher resolution images and require lower energy for image fixing than do dry toner. Typically, the carrier liquid is a hydrocarbon that has a low dielectric constant (e.g., less than 3). Examples of such carrier liquids include NORPAR™ and ISOPAR™ solvents from Exxon Chemical Company.

Direct transfer uses an electrostatic assist to transfer the toner from the photoreceptor to the final substrate. See e.g. U.S. Pat. Nos. 4,849,784; 5,010,370; and 5,115,277. This method, therefore, requires high voltages and generates ozone due to the coronas producing the electrostatic assist. Ozone may lead to degradation of certain components inside the electrophotographic apparatus if allowed to accumulate. In addition, if the transfer charge is too high, toner may shift from an imaged area to a non-imaged area. Toner may also scatter when the substrate separates from the photoreceptor. The electrostatic assist renders the process sensitive to humidity particularly in dry toner systems. Finally, if a multicolor image is being formed, it may be difficult to keep the colors in registration.

For those reasons, a two step process may be used in which the image is first transferred to an intermediate transfer element, such as a roll, belt, blanket, etc. The first step may be referred to as T1. The image is then transferred to the final substrate. This transfer may be called T2. Either or both of T1 and T2 may be accomplished by electrostatic assist. Alternatively, T1 and/or T2 may occur using heat and pressure. If both transfers occur via heat and pressure, the surface energy of the intermediate transfer element must be intermediate to the surface energy of the surface of the photoreceptor (usually a release layer) and the surface energy of the toner. Unfortunately, image quality sometimes deteriorates when an intermediate transfer element is used. Hollow characters and halos are among the more common defects.

With liquid toners, the presence of the carrier liquid further complicates the transfer steps. While the presence of carrier liquid may facilitate electrostatic transfer, transfer of the carrier liquid to the final substrate is undesirable. Since the toner particles in liquid toned systems are smaller than in dry systems, Van der Waals forces make dry transfer difficult.

Past approaches for transferring liquid toned images with heat and pressure have concentrated on drying or partially drying the toned images before transfer to the intermediate transfer element (see e.g. U.S. Pat. No. 5,552,869 and U.S. Pat. No. 5,650,253, and using an intermediate transfer element that is highly resistant to the carrier liquid (see e.g. U.S. Pat. Nos. 3,811,765; 4,522,866; 5,047,808; 5,099,286; 5,119,140; 5,337,129; and 5,340,679). The use of a carrier liquid resistant material in the intermediate transfer element simplifies removal of the carrier liquid from the intermediate transfer element so that passage of the carrier liquid to the final substrate and out of the system is minimized. Unfortunately, these, methods do not eliminate all image defects from the final image. Particularly since it is difficult to ensure that all areas of an image (e.g. both isolated dots and large solids areas) are dried to the same extent. Therefore, a improved method of drying and/or transfer is still needed for liquid electrophotographic systems.

SUMMARY OF THE INVENTION

The Applicants have discovered that when an intermediate transfer element having some affinity for carrier liquid is used, a separate drying step, after formation of the image on the photoreceptor and before transfer to the intermediate transfer element, is no longer a requirement. However, the intermediate transfer element of this invention provides improvements in image quality even when used in combination with a separate drying step. This novel intermediate transfer element enables complete transfer of the image to the final substrate without deterioration in image quality.

According to a first embodiment, the present invention is an intermediate transfer element for liquid electrophotography comprising a material that absorbs toner carrier liquid in amounts from about 5 to about 100% by weight based on the weight of the absorbent material.

According to a second embodiment, the present invention is an electrographic imaging system comprising a photoreceptor;

a charge producing means for producing an image-wise distribution of charges on the photoreceptor;

a liquid toner comprising toner particles in a carrier liquid; an application means for applying the liquid toner to the photoreceptor forming an image-wise distribution of the toner particles on the photoreceptor to form the image; and an intermediate transfer element receiving the image from the photoreceptor and transferring the image to the receptor, wherein the intermediate transfer element comprises a material capable of absorbing the carrier liquid in amounts from about 5 to about 100% by weight based on the weight of the absorbing material. Preferably, the charge producing means comprises a means for producing a uniform charge on the photoreceptor and an image producing means for producing an image-wise distribution of charge on the photoreceptor.

According to a third embodiment this invention is a process for creating an image comprising the steps of:

producing an image-wise distribution of charges on a photoreceptor corresponding to the image data;

applying a liquid toner comprising solid charged pigmented toner particles in a carrier liquid to the photoreceptor forming an image-wise distribution of the toner particles on said photoreceptor to form the image;

transferring the image from the photoreceptor to an intermediate transfer element forming a first transfer nip under pressure with the photoreceptor, the intermediate transfer element comprising a material capable of absorbing the carrier liquid in amounts from 5 to 100% by weight based on the weight of the absorbing material;

transferring the image from the intermediate transfer element to a receptor media.

BRIEF DESCRIPTION OF THE DRAWING

The Figure illustrates an apparatus for producing a multi-colored image.

DETAILED DESCRIPTION OF THE INVENTION

The intermediate transfer roll of this invention can be used with any electrophotographic system that employs a liquid toner and an intermediate transfer step prior to transfer of the image to the final receptor. Some preferred electrographic systems are disclosed in U.S. patent application Ser. No. 08/948,437 pending and U.S. Pat. No. 5,650,253, incorporated herein by reference.

The System

The Figure diagrammatically illustrates an apparatus 42 and method for producing a multi-colored image. Photoreceptor 10 is mechanically supported by belt 44 which rotates in a clockwise direction around rollers 46 and 48. Alternatively the photoreceptor can be supported on some other moveable object such as a drum as shown for example in U.S. patent application Ser. No. 08/948,437. Photoreceptor 10 is first conventionally erased with erase lamp 14. Any residual charge left on photoreceptor 10 after the preceding cycle is preferably removed by erase lamp 14 and then conventionally charged using charging device 18, such procedures being well known in the art. When so charged, the surface of photoreceptor 10 is uniformly charged to around 600 volts, preferably. Laser scanning device 50 exposes the surface of photoreceptor 10 to radiation in an image-wise pattern corresponding to a first color plane of the image to be reproduced.

With the surface of photoreceptor so image-wise charged, charged pigment particles in liquid toner 54 corresponding to the first color plane will migrate to and plate upon the surface of photoreceptor 10 in areas where the surface voltage of photoreceptor 10 is less than the bias of electrode 56 associated with liquid toner developer station 52. The charge neutrality of liquid toner 54 is maintained by negatively charged counter ions which balance the positively charged pigment particles. Counter ions are deposited on the surface of photoreceptor 10 in areas where the surface voltage is greater than the bias voltage of electrode 56 associated with liquid toner developer station 52.

At this stage, photoreceptor 10 contains on its surface an image-wise distribution of plated "solids" of liquid toner 54 in accordance with a first color plane. The surface charge distribution of photoreceptor 10 has also been equilibrated to the development bias voltage with plated toner particles as well as with transparent counter ions from liquid toner 54 both being governed by the image-wise discharge of photoreceptor 10 due to laser scanning device 58. Thus, at this stage the surface charge of photoreceptor 10 is also quite uniform. Although not all of the original surface charge of photoreceptor 10 may have been obtained, a substantial portion of the previous surface charge of photoreceptor 10 has been recaptured. With such solution recharging, photoreceptor 10 is now ready to be processed for the next color plane of the image to be reproduced. Optionally, a charging device may be used to increase the charge on the photoreceptor between each color plane. Such devices include coronas, voll chargers, etc.

As belt 44 continues to rotate, photoreceptor 10 next is image-wise exposed to radiation from laser scanning device 58 corresponding to a second color plane. Note that this process occurs during a single revolution of photoreceptor 10 by belt 44 and without the necessity of photoreceptor 10 being subjected to erase subsequent to exposure to laser scanning device 50 and liquid toner development station 52 corresponding to a first color plane. The remaining charge on the surface of photoreceptor 10 is subjected to radiation corresponding to a second color plane. This produces an image-wise distribution of surface charge on photoreceptor 10 corresponding to the second color plane of the image.

The second color plane of the image is then developed by developer station 60 containing liquid toner 62. Although liquid toner 62 contains "solid" color pigments consistent with the second color plane, liquid toner 62 also contains substantially transparent counter ions which, although they may have differing chemical compositions than substantially transparent counter ions of liquid toner 54, still are substantially transparent and oppositely charged to the "solid" color pigments. Electrode 64 provides a bias voltage to allow "solid" color pigments of liquid toner 62 create a pattern of "solid" color pigments on the surface of photoreceptor 10 corresponding to the second color plane. The transparent counter ions also substantially recharge photoreceptor 10 and make the surface charge distribution of photoreceptor 10 substantially uniform so that another color plane may be placed upon photoreceptor 10 without the necessity of erase nor corona charging. These devices, however, may be used if desired.

A third color plane of the image to be reproduced is deposited on the surface of photoreceptor 10 in similar fashion using laser scanning device 66 and developer station 68 containing liquid toner 70 using electrode 72. Again, the surface charge existing on photoreceptor 10 following development of the third color plane may be somewhat less than existed prior to exposure to laser scanning device 66 but will be substantially "recharged" and will be quite uniform allowing application of the fourth color plane without the necessity of erase or corona charging. These devices, however, may be used if desired.

Similarly, a fourth color plane is deposited upon photoreceptor 10 using laser scanning device 74 and developer station 76 containing liquid toner 78 using electrode 80.

Preferably, excess liquid from liquid toners 54, 62, 70 and 78 is "squeezed" off using a roller 82, 84, 86, and 88 respectively. The plated solids from liquid toners 54, 62, 70 and 78 may then be dried in an optional drying mechanism 34 such as air blowers, drying rollers, vacuum devices, coronas, etc. However, due to the novel nature of the intermediate transfer element 38, such a drying step is not needed in order to provide good image quality. If such a drying step is used it preferably dries the image to a volume % solids of no less than about 95%.

The completed four color image is then transferred, either directly to the medium 36 to be printed, or preferably and as illustrated in the Figure, indirectly by way of transfer rollers 38 and back-up roll 40. Typically, heat and/or pressure are utilized to fix the image to medium 36. The resultant "print" is a hard copy manifestation of the four color image.

With proper selection of charging voltages, photoreceptor capacity and liquid toner, this process may be repeated any desired number of times to produce a multi-colored image having any desired number of color planes. Although the process and apparatus has been described above for conventional four color images, the process and apparatus are suitable for multi-color images having two or more color planes. Or, of course, a single scanning device and application station may be used to provide single color images or to provide multi-color images by repeating the single application method with various colors. According to the latter multi-color method, the colors may be superimposed on each other prior to transfer or each color may be transferred prior to application of a new color to the photoreceptor.

The system preferably has the ability to make duplex images, i.e. on both sides of a receptor. However, since according the preferred embodiment heat and pressure are used to transfer the image from the intermediate transfer roll to the receptor, the first image may degrade from contact with the backup roller while the second image is being transferred to the backside. In order to limit this image degradation, it is desirable to use a backup roll having a very low surface energy. Suitable materials include any release material which has a surface tension lower than that of the toner, preferably at least 0.5, more preferably at least 1.0 and most preferably at least 5, dyne/cm below than of the toner. Possible materials include crosslinked silicone polymers as disclosed in WO96/34318, Syloff™ release materials from Dow Corning Corp., fluoropolymers, fluorosilicones, polyethylene, and polypropylene.

The Photoreceptor

Any known photoreceptor may be used. Preferred photoreceptors comprise an electroconductive substrate, a photoconductive layer, an interlayer, and a release layer. The photoreceptor may be of a drum type construction, a belt construction, or any other construction known in the art.

Electroconductive substrates for photoconductive systems are well known in the art and are generally of two general classes: (a) self-supporting layers or blocks of conducting metals, or other highly conducting materials; (b) insulating materials such as polymer sheets, glass, or paper, to which a thin conductive coating, e.g. vapor coated aluminum, has been applied.

The photoconductive layer can be any type known in the art, including (a) an inorganic photoconductor material in particulate form dispersed in a binder or, more preferably, (b) an organic photoconductor material. Photoconductor elements having organic photoconductor material are discussed in Borsenberger and Weiss, *Photoreceptors: Organic Photoconductors*, Ch. 9 Handbook of Imaging Materials, ed. Arthur S. Diamond, Marcel Dekker, Inc. 1991. When an organic photoconductor material is used, the photoconductive layer can be a bilayer construction consisting of a charge generating layer and a charge transport layer. The charge generating layer includes a material which is capable of absorbing light to generate charge carriers, such as a dyestuff or pigment. The charge transport layer includes a material capable of transferring the generated charge carriers, such as poly-N-vinylcarbazoles or derivatives of bis-(benzocarbazole)-phenylmethane in a suitable binder. In standard use of bilayer organic photoconductor materials in photoconductor elements, the charge generation layer is located between the conductive substrate and the charge transport layer. Alternatively, an inverted bilayer system, in which the charge transport layer is located between the conductive substrate and the charge generation layer, may be used. Photoconductor elements having an inverted bilayer organic photoconductor material require positive charging which results in less deterioration of the photoreceptor surface. An example of a preferred inverted bilayer system is found in Example 6 of U.S. Pat. No. 5,652,078, incorporated herein by reference. As yet another alternative, an organic photoconductive layer can comprise a single-layer construction containing a mixture of charge generation and charge transport materials and having both charge generating and charge transport capabilities. Examples of single-layer organic photoconductive layers are described in U.S. Pat. Nos. 5,087,540 and 3,816,118.

Inorganic photoconductors such as, for example, zinc oxide, titanium dioxide, cadmium sulfide, and antimony sulfide, dispersed in an insulating binder are well known in the art and may be used in any of their conventional versions with the addition of sensitizing dyes where required. The preferred binders are resinous materials, including, but not limit to, styrenebutadiene copolymers, modified acrylic polymers, vinyl acetate polymers, styrene-alkyd resins, soya-alkyl resins, polyvinylchloride, polyvinylidene chloride, acrylonitrile, polycarbonate, polyacrylic and methacrylic esters, polystyrene, polyesters, and combinations thereof Possible interlayers include a barrier layer which protects the photoconductor layer from the toner carrier liquid and other compounds which might damage the photoconductor. The barrier layer may also protect the photoconductive layer from damage that could occur from charging the photoconductor element with a high voltage corona. The barrier layer, like the release layer, must not significantly interfere with the charge dissipation characteristics of the photoconductor element and must adhere well to the photoconductive layer and the release layer, preferably without the need for adhesives. The barrier layer may be any known barrier layer, such as a crosslinkable siloxanol-colloidal silica hybrid as disclosed in U.S. Pat. Nos. 4,439,509; 4,606,934; 4,595,602; and 4,923,775; a coating formed from a dispersion of hydroxylated silsesquioxane and colloidal silica in an alcohol medium as disclosed by U.S. Pat. No. 4,565,760; or a polymer resulting from a mixture of polyvinyl alcohol with methylvinylether/maleic anhydride copolymer. Preferably the barrier layer is polyvinyl butyral crosslinked with 2,5 furandione polymer with methoxyethene and containing about 30% silica.

Possible release layers include any known release layer for photoreceptors, such as fluorinated polymers, siloxane polymers, silanes, polyethylene, and polypropylene. Preferred release layers include cross-linked silicone polymers. See e.g. WO96/34318, U.S. Pat. No. 5,733,698, U.S. patent application Ser. No. 08/832,834 pending, all of which are incorporated herein by reference. If desired, the release layer may have a surface roughness, Ra of from 0 to 500 nm. Roughness may be created on the release layer by any known method, such as, for example addition of particulates, abrading, control of coating methods as disclosed in U.S. patent application Ser. No. 08/833,111, pending incorporated herein by reference.

The Toners

Any liquid toners used in liquid electrophotography can be used. Typically the liquid toner will comprise a colorant, a resin binder, a charge director, and a carrier liquid. A preferred resin to pigment ratio is 2:1 to 10:1, more preferably 4:1 to 8:1. Typically, the colorant, resin, and the charge director form the toner particles. The liquid toners can use any of the standard carrier liquids. The carrier liquids are typically oleophilic, chemically stable, and electrically insulating. Substituted and unsubstituted hydrocarbon solvents are frequently used. Any known dyes or pigments can be used as the colorant. The resin, preferably, helps to stabilize the dispersion of colorant containing toner particles in the carrier liquid. Preferably, the toners are film-forming, i.e. the volume % of solids after passing the film-forming means (e.g. squeegee) is greater than 74%. To assist in film formation of the toned image, it is helpful for the resin to have a glass transition temperature between −10° C. and 25° C., more preferably −5 to 10° C. If Tg of the toner is greater than the development temperature (i.e., the temperature at which the toner is applied to the photoreceptor) temperature at which transfer occurs most optimally should be increased relative to that of film-formed toners.

Preferred toners are gel liquid toners as disclosed in U.S. Pat. No. 5,652,282, incorporated herein by reference and organosol toners having crystalline side chains as disclosed in U.S. Pat. No. 5,886,067, incorporated herein by reference. Because the toner shell tends to retain carrier liquid, core:shell weight ratios of 4:1–10:1 are preferred, 6:1–8:1 are more preferred.

If multiple color planes are plated to the photoconductor between transfers, the toners preferably are substantially transparent to the wavelength of radiation used as the imaging radiation source. Transmission of at least 80% of the radiation from the imaging radiation source is preferred. Little or no scattering by the liquid toned image of the radiation from the imaging radiation source is also desirable.

The Charging Device and The Imaging Radiation Source

Any known device that would provide a charge to the surface of the photoreceptor may be used. However, Applicants have found that a scorotron type corona charging device capable of providing a surface voltage on the photoreceptor of 350 to 1000 volts is suitable. Laser scanning devices are the preferred imaging radiation source.

The Application Means

Conventional liquid toner development techniques may be used. Preferably the Application means includes a developer element, a squeegee, a fluid delivery system and a fluid recovery system. The developer element bears a bias voltage intermediate to the surface potential of the exposed portions of the photoreceptor and the surface potential of the unexposed portions of the photoreceptor. The developer element bearing liquid toner is brought into proximity with the photoreceptor, and the voltage difference between the developer element and the photoreceptor force the charged toner particles to migrate to the photoreceptor. Preferably, a squeegee element is used to remove excess liquid toner. For preferred application means see U.S. Pat. No. 5,650,253 (squeegee), U.S. Pat. No. 5,576,815 (developer apparatus), U.S. Pat. No. 5,731,068 (excess toner remover), and U.S. Pat. No. 5,596,398 (cleaning roller) and U.S. Pat. No. 5,300,990 (developer station), all incorporated herein by reference.

Transfer Roll

The assembled image is transferred in a single step to an intermediate transfer element for subsequent transfer to a receptor. The assembled image on the surface of photoreceptor is brought into pressure contact with intermediate transfer element which is preferably heated. The temperature of the transfer element is preferably in the range of 25–130 degrees Celsius. Although a roller is preferred for intermediate transfer element 38, a belt or other such mechanisms are also envisioned. The preferred pressure for contact between intermediate transfer element 38 and photoreceptor 10 is preferably on the order of 30–60 kilograms with a preferred contact or nip width of 4–6 mm (or an area of 5–10 square centimeters). The assembled liquid toner image adheres to the elastomer of intermediate transfer element 38 when photoreceptor 10 and the elastomer surface of intermediate transfer element 38 are separated. The surface of photoreceptor 10 releases the liquid toner image.

The intermediate transfer element of this invention, unlike other transfer rollers known to the inventors, comprises a material which has some affinity for the carrier liquid. Such transfer rollers are tolerant of different degrees of dryness within the same image and all such areas are properly transferred without distortion. Such transfer rollers also allow for the elimination of a separate drying step. The degree of affinity may be defined by how much swelling of the material occurs when the material is soaked in carrier liquid for 10 minutes. The material should display swelling of about 5 to about 100%, preferably about 10 to about 95%, more preferably about 20 to about 90%, and most preferably 30 about to about 80% based on weight of the material. Too much absorption leads to large dimensional changes which make control of nip force and nip width difficult. Too much absorption may also alter surface properties which can lead to transfer problems. Too little absorption makes the transfer conditions very sensitive to the degree of image dryness and image defects may result from improper transfer of some portion of the image.

The material having affinity to the carrier liquid is preferably borne on a solid substrate such as metal, hard plastics, wood, etc. A roll having an aluminum core is especially preferred. The absorbent material may be formed and. applied to the core by any known method. For example, the absorbent material may be compression molded then adhered to the core with an adhesive tacky to both the core material and the absorbent material.

In order to accommodate the pressure and dwell time requirements and to accommodate irregularities in the surface of the receptor, an elastomeric material is preferred. An elastomer having a Shore A Durometer hardness of about 65 or less, preferably 50–60, works well.

Moreover, the material of intermediate transfer element 38 should have sufficient adhesive properties to pick up the image from the surface of photoreceptor surface and sufficient release to allow the image to be transferred to receptor medium 36. Specifically, the material of intermediate transfer element 38 has an adhesive characteristic relative to liquid toners 52, 60, 68 and 76 that is greater than the adhesive characteristic of liquid toners 52, 60, 68 and 76 to the release surface of photoreceptor 10 at the temperature of the contact between the transfer element and the photoreceptor, but less than the adhesive characteristic of liquid toners 52, 60, 68 and 76 and final receptor medium 36 at the contact temperature of the transfer element and the final receptor. The choice of the elastomer of intermediate transfer element 38 is dependent on the release surface of photoreceptor 10, the composition of liquid toners 52, 60, 68 and 76, and receptor medium 36. Preferred surface energies are in the range from about 25 to about 35 dyne/cm based on typical toner and photoreceptor release surfaces.

To rephrase, the transfer technique of the present invention preferably relies on a relative surface energy hierarchy among the surface release layer of photoreceptor 10, intermediate transfer element 38, liquid toners 54, 62, 70 and 78 and receptor medium 36. The surface energy of photoreceptor 10 should be less than the surface energy of intermediate transfer element 38. Further, the surface energy of intermediate transfer element 38 should be less than the surface energies of liquid toners 54, 62, 70 and 78. Still further, the surface energy of liquid toners 54, 62, 70 and 78 should be less than the surface energy of receptor medium 36. This relative hierarchy helps ensure a reliable and sequential transfer of the assembled color plane image during the method and apparatus of the present invention.

It is also preferred that the surface energy of photoreceptor 10 be at least 0.5 dyne per centimeter less than the surface energy of intermediate transfer element 38. Most preferred is that the surface energy of photoreceptor 10 be at least 1.0 dyne per centimeter less than the surface energy of intermediate transfer element 38.

It is also preferred that the surface energy of intermediate transfer element 38 be at least 2.0 dyne per centimeter less than the surface energy of liquid toners 54, 62, 70 and 78. Most preferred is that the surface energy of intermediate transfer element 38 be at least 4.0 dyne per centimeter less than the surface energy of liquid toners 54, 62, 70 and 78.

All surface energies are measured in dyne per centimeter at approximately room temperature, preferably at about 20–23 degrees Celsius. Typically, the surface energy of photoreceptor 10 ranges from about 22 dyne per centimeter to about 26 dyne per centimeter. Typically, the surface energy of intermediate transfer element 38 ranges from about 26 dyne per centimeter to about 30 dyne per centimeter. Typically, the surface energy of liquid toners 54, 62, 70 and 78 ranges from about 30 dyne per centimeter to about 40 dyne per centimeter. Typical surface energies for receptor medium 36 range from about 40 dyne per centimeter for plain paper to about 42 for transparency film.

Suitable materials for the transfer element that are elastomeric, have affinity for the hydrocarbon carrier liquids (e.g. Norpar™ carrier liquids), and have the necessary adhesion and release properties include crosslinked isoprene, natural rubber, EPDM rubbers, and certain crosslinked silicone elastomers. If other carrier liquids are used (e.g. silicone oils, fluorinated liquids, etc.) elastomers with appropriate affinity should be chosen.

EXAMPLES

Examples 1–3 and Comparative Examples 1–4

Various transfer element materials were tested in an electrophotographic system having:

1) A photoconductor supported on a drum as disclosed in U.S. patent application Ser. No. 08/948,437. For examples 1–3 and comparative examples 1–3 the photoconductor was as disclosed in U.S. Pat. No. 5,652,078, Example 1. For comparative example 4, the photoconductor was as disclosed in U.S. Pat. No. 5,652,078, Example 6 but the charge transfer layer is 8.75 $\mu$m thick, the charge generating layer is 0.3 $\mu$m thick and DC510 from Dow Corning Corp. was added as a coating aid to the charge generating layer in amounts less than 0.01%

2) The system had 4 developing stations.

3) A drying station was used for some but not all image samples. This drying station is described in U.S. Pat. No. 5,552,869.

4) A corona charger was used to establish a bias voltage of 500. The system had a grid voltage of 750 V. A 1.5 mW laser at 50% duty cycle was used to create the latent image on the photoconductor.

5) An aluminum backup roll was maintained at 115° C.

6) The image was transferred onto plain paper.

7) The transfer element had an elastomeric material applied to an Aluminum core. The elastomeric material was compression molded and surface ground to remove flash from molding. The core had an outer diameter of 3.429 cm and the element as a whole had an outer diameter of 3.99 cm. For Comparative Examples 1–4, a polyurethane was used as the base and overcoated with 0.01 cm of the indicated elastomers by spray coating. The transfer element was maintained at 85° C.

8) The toner use was as disclosed in Examples 16–19 of U.S. Pat. No. 5,886,067.

The material used in the transfer roll was varied and the system was run with and without use of the drying station. Print quality of dots (<100 $\mu$m spot) and of solids on the final receptor were evaluated for complete transfer and edge sharpness. In addition, each transfer element material was tested to determine surface energy on a Krüss K121 by dynamic contact angle according to the Wilhelmz plate method. Water, ethylene glycol and formamide were used as the probe fluids and the harmonic mean method of Wu described in Polymer Interface and Adhesion, Marcel Dekker, N.Y. 1982. Affinity to the carrier liquid was determined by preparing a 2 square centimeter sample of the material 0.254 cm thick, weighing the sample, soaking that sample in Norpar™ 12 for 10 minutes at room temperature, patting the sample dry, and determining weight after soaking. The % absorption=100×(weight after soaking—original weight)/original weight.

| | | Surface Energy | Absorption | Print Quality With Drying | | Print Quality Without Drying | |
|---|---|---|---|---|---|---|---|
| Example | Material | (dyne/cm) | (% by weight) | Dots | Solids | Dots | Solids |
| 1 | K7517 Crosslinked silicone from Rogers Corp. | 25 | 70 | fair-good | good | good | good |
| 2 | A7512 crosslinked polyisoprene from Rogers Corp. | 30 | 30 | fair | good | good | good |
| 3 | A7418 crosslinked polyisoprene from Rogers Corp. | 30 | 60 | good | good | good | good |
| Comp. 1 | 94-003 crosslinked fluorosilicone from Dow Corning Corp. | 27 | 0.5 | good | fair-poor | poor | good |
| Comp. 2 | 94-003-162 crosslinked fluorosilicone from Dow | 28 | 0.3 | good | fair | poor | poor |

-continued

| Example | Material | Surface Energy (dyne/cm) | Absorption (% by weight) | Print Quality With Drying | | Print Quality Without Drying | |
|---|---|---|---|---|---|---|---|
| | | | | Dots | Solids | Dots | Solids |
| Comp. 3 | Corning Corp. DC738 crosslinked silicone from Dow Corning Corp. | 24 | 120 | fair | fair | poor | poor |
| Comp. 4 | Material D, Example 4, U.S. Pat. No. 5,552,869 crosslinked silicone | 22 | 160 | poor | poor | poor | poor |

EXAMPLE 4—Duplexing

Images were made on plain paper as described in Example 1. The backside of the plain paper was then used as the receptor for a second imaging cycle. When an Aluminum back-up roll to the transfer roll was used for the second imaging cycle, toner from the first image was transferred to the Aluminum back-up roll significantly deteriorating the original image on the frontside of the paper. When the Aluminum back-up roll was replaced with a roll covered with 94-003-162 crosslinked fluorosilicone from Dow Corning Corp. no toner from the original image transferred to the back-up roll during the second imaging cycle.

What is claimed is:

1. A system for producing an image on a receptor medium comprising a photoreceptor;

a charge producing means for producing an image-wise distribution of charges on the photoreceptor;

a liquid toner comprising toner particles in a carrier liquid;

at least one application means for applying the liquid toner to the photoreceptor forming an image-wise distribution of the toner particles on the photoreceptor to form the image;

an intermediate transfer element for receiving the image from the photoreceptor and transferring the image to the receptor medium, said intermediate transfer element comprising a material capable of absorbing the carrier liquid in amounts from 5 to 100% by weight based on weight of the absorbing material, and a receptor medium, wherein the photoreceptor, the intermediate transfer element, the liquid toner, and the receptor medium each have a surface energy and wherein (a) the surface energy of the photoreceptor is less than the surface energy of the intermediate transfer element, (b) the surface energy of the intermediate transfer element is less than the surface energy of the liquid toner, and (c) the surface energy of the liquid toner is less than the surface energy of the receptor medium.

2. The system of claim 1 wherein the material comprising the intermediate transfer element is elastomeric.

3. The system of claim 1 wherein a film forming means is positioned against the photoreceptor immediately following each of the at least one application means wherein the film forming means dries the liquid toner within 0.5 seconds to a volume fraction solids of at least 74% based on total volume of the liquid toner image.

4. The system of claim 3 wherein the image is received by the intermediate transfer element directly after passing the film forming means.

5. The system of claim 1 wherein the image is received by the intermediate transfer element directly after being applied to the photoreceptor.

6. The system of claim 1 further comprising a drying means before the intermediate transfer element.

7. The system of claim 6 wherein the image is dried to a volume fraction solids of at least 95% before the image is received by the intermediate transfer element.

8. The system of claim 1 further comprising a backup element forming a transfer nip under pressure with the intermediate transfer element and the receptor media passing between the backup element and the intermediate transfer roll.

9. The system of claim 1 in which the toners are film-forming toners having a Tg in the range from −10 to 25° C.

10. The system of claim 1 in which the toner particles comprise a core and a shell with a core:shell weight ratio in the range of 4:1 to 10:1.

11. A method of producing an image on a receptor medium from image data, comprising the steps of:

producing an image-wise distribution of charges on a photoreceptor corresponding to the image data;

applying a liquid toner comprising solid charged pigmented toner particles in a carrier liquid to the photoreceptor forming an image-wise distribution of the toner particles on said photoreceptor to form the image;

transferring the image from the photoreceptor to an intermediate transfer element forming a first transfer nip under pressure with the photoreceptor, said intermediate transfer element comprising a material capable of absorbing the carrier liquid in amounts from 5 to 100% by weight based on weight of the absorbing material; and transferring the image from the intermediate transfer element to a receptor medium, wherein the photoreceptor, the intermediate transfer element, the liquid toner, and the receptor medium each have a surface energy and wherein (a) the surface energy of the photoreceptor is less than the surface energy of the intermediate transfer element, (b) the surface energy of the intermediate transfer element is less than the surface energy of the liquid toner, and (c) the surface energy of the liquid toner is less than the surface energy of the receptor medium.

12. The method of claim 11 further comprising fixing the image immediately following said applying step with a film forming means positioned against the photoreceptor for drying the image of the liquid toner to film forming within 0.5 seconds so that the image on the photoreceptor has greater than seventy-five percent by volume fraction of solids.

13. The method of claim 11 wherein the image is received by the intermediate transfer element directly after passing the film forming means.

14. The method of claim 11 wherein the image is received by the intermediate transfer roll directly after being applied to the photoreceptor.

15. The method of claim 11 wherein in transferring the image to the receptor media, the receptor media passes between the intermediate transfer element and a backup element forming a transfer nip under pressure with the intermediate transfer element.

16. The method of claim 11 further comprising drying to a volume fraction solids of at least 95% before the image is received by the intermediate transfer element.

17. The method of claim 11 wherein the toners are film-forming toners having a Tg in the range from −10 to 25° C.

18. The method of claim 11 in which the toner particles comprise a core and a shell with a core:shell weight ratio in the range of 4:1 to 10:1.

19. A system for producing an image on a receptor media from image data, consisting essentially of:

a photoreceptor;

a liquid toner having solid charged pigmented toner particles dispersed in a carrier liquid, said liquid toner having an effective glass transition temperature of not less minus 10 degrees Celsius but at least one degree less than the temperature at which development takes place;

at least one image producing station comprising (a) a charge producing means for producing an image-wise distribution of charges on the photoreceptor corresponding to the image data, (b) an application means for applying the liquid toner to the photoreceptor forming an image-wise distribution of the pigmented toner particles on the photoreceptor to form the image, and (c) a film forming means positioned against the photoreceptor immediately following the application means for drying the image of the liquid toner to film forming within 0.5 seconds so that the liquid toner has greater than seventy-five percent by volume fraction of solids in the image;

an elastomeric transfer element forming a first transfer nip under pressure with the photoreceptor, the transfer element receiving the image from the photoreceptor, the elastomeric transfer element being heated to from 50 degrees Celsius to 100 degrees Celsius, wherein the element comprises a material capable of absorbing the carrier liquid in amounts from 5 to 100% by weight based on the weight of the absorbing material; and a backup element forming a second transfer nip under pressure with the transfer element, the receptor media passing through the second transfer nip and receiving the image from the transfer element;

the photoreceptor having a surface energy which is less than a surface energy of the elastomeric transfer element, the surface energy of the elastomeric transfer element being less than a surface energy of the liquid toner;

the surface energy of the image formed by the liquid toner being less than a surface energy of the receptor media.

20. A method of producing an image on a receptor media from image data, consisting essentially of the steps of:

producing an image-wise distribution of charges on a photoreceptor corresponding to the image data;

one or more times in series (a) applying a liquid toner, comprising solid charged pigmented toner particles in a carrier liquid and having an effective glass transition temperature of not less than minus 10 degrees Celsius but at least one degree less than the temperature at which development takes place, to the photoreceptor forming an image-wise distribution of the pigmented toner particles on the photoreceptor to form the image, and (b) fixing the image immediately following the applying step with a film forming means positioned against the photoreceptor for drying the image of the liquid toner to film forming within 0.5 seconds so that the image has greater than seventy-five percent by volume fraction of solids;

transferring the image from the photoreceptor to an elastomeric transfer element forming a first transfer nip under pressure with the photoreceptor, the elastomeric transfer element being heated to from 50 degrees Celsius to 100 degrees Celsius wherein the element comprises a material capable of absorbing the carrier liquid in amounts from 5 to 100% by weight based on the weight of the absorbing material; and transferring the image from the elastomeric transfer element to a receptor media in a second transfer nip under pressure from a backup element, the receptor media passing through the second transfer nip;

the photoreceptor having a surface energy which is less than a surface energy of the elastomeric transfer element;

the surface energy of the elastomeric transfer element being less than a surface energy of the liquid toner;

the surface energy of the image formed by the liquid toner being less than a surface energy of said receptor media.

21. The system of claim 1 wherein the intermediate transfer element comprises a material capable of absorbing the carrier liquid in amounts from 10 to 95% by weight based on weight of the absorbing material.

22. The system of claim 1 wherein the intermediate transfer element comprises a material capable of absorbing the carrier liquid in amounts from 20 to 90% by weight based on weight of the absorbing material.

23. The system of claim 1 wherein the intermediate transfer element comprises a material capable of absorbing the carrier liquid in amounts from 30 to 80% by weight based on weight of the absorbing material.

24. The method of claim 11 wherein the material comprising the intermediate transfer element is elastomeric.

25. The method of claim 11 wherein the intermediate transfer element comprises a material capable of absorbing the carrier liquid in amounts from 10 to 95% by weight based on weight of the absorbing material.

26. The method of claim 11 wherein the intermediate transfer element comprises a material capable of absorbing the carrier liquid in amounts from 20 to 90% by weight based on weight of the absorbing material.

27. The method of claim 11 wherein the intermediate transfer element comprises a material capable of absorbing the carrier liquid in amounts from 30 to 80% by weight based on weight of the absorbing material.

* * * * *